United States Patent [19]

Mitchell et al.

[11] 3,978,526

[45] Sept. 7, 1976

[54] PERISCOPE REAR VIEW HELMET AND HELMET ADAPTER

[76] Inventors: William Leroy Mitchell, 760 Kennebec Court, Bloomfield Hills, Mich. 48013; John W. Yee, 8870 E. Outer Drive, Detroit, Mich. 48213

[22] Filed: Apr. 9, 1975

[21] Appl. No.: 566,260

[52] U.S. Cl. ..... 2/422; 2/DIG. 8; 350/304

[51] Int. Cl.[2] ..... A42B 3/02; G02B 5/08

[58] Field of Search ..... 2/3 R, 6, 9, 10, 14 W, 2/DIG. 8; 350/298, 301, 303, 304

[56] References Cited

UNITED STATES PATENTS

| | | | |
|---|---|---|---|
| 2,522,938 | 9/1950 | Francis et al. | 350/298 X |
| 3,712,714 | 1/1973 | Uyeda et al. | 350/301 |
| 3,804,495 | 4/1974 | Rayow et al. | 350/298 |

FOREIGN PATENTS OR APPLICATIONS

| | | | |
|---|---|---|---|
| 272,032 | 8/1964 | Australia | 350/301 |
| 1,062,289 | 12/1953 | France | 350/298 |
| 757,167 | 9/1956 | United Kingdom | 350/298 |

*Primary Examiner*—Werner H. Schroeder
*Attorney, Agent, or Firm*—McGlynn and Milton

[57] ABSTRACT

A head helmet including a head protective shell having a crown and a brim defining the top of an open facial area with a frontal area of the shell extending downwardly from the crown to the brim extremity. A mirror optical system is supported in a tunnel disposed forwardly of the frontal area of the shell and includes a scanning mirror positioned adjacent the crown for receiving rearward images and reflecting the images downwardly to a reflecting mirror positioned adjacent the brim extremity and facing generally upwardly toward the scanning mirror for reflecting the rearward images from the scanning mirror generally upwardly and forwardly to a viewing mirror positioned above and forwardly of the reflecting mirror and the brim extremity and generally facing rearwardly and downwardly for reflecting the rearward images from the reflecting mirror into the open facial area to the wearer's eyes whereby the image line between the wearer's eyes and the viewing mirror crosses the image line between the reflecting mirror and the scanning mirror.

7 Claims, 6 Drawing Figures

PERISCOPE REAR VIEW HELMET AND HELMET ADAPTER

BACKGROUND

Figure 1:
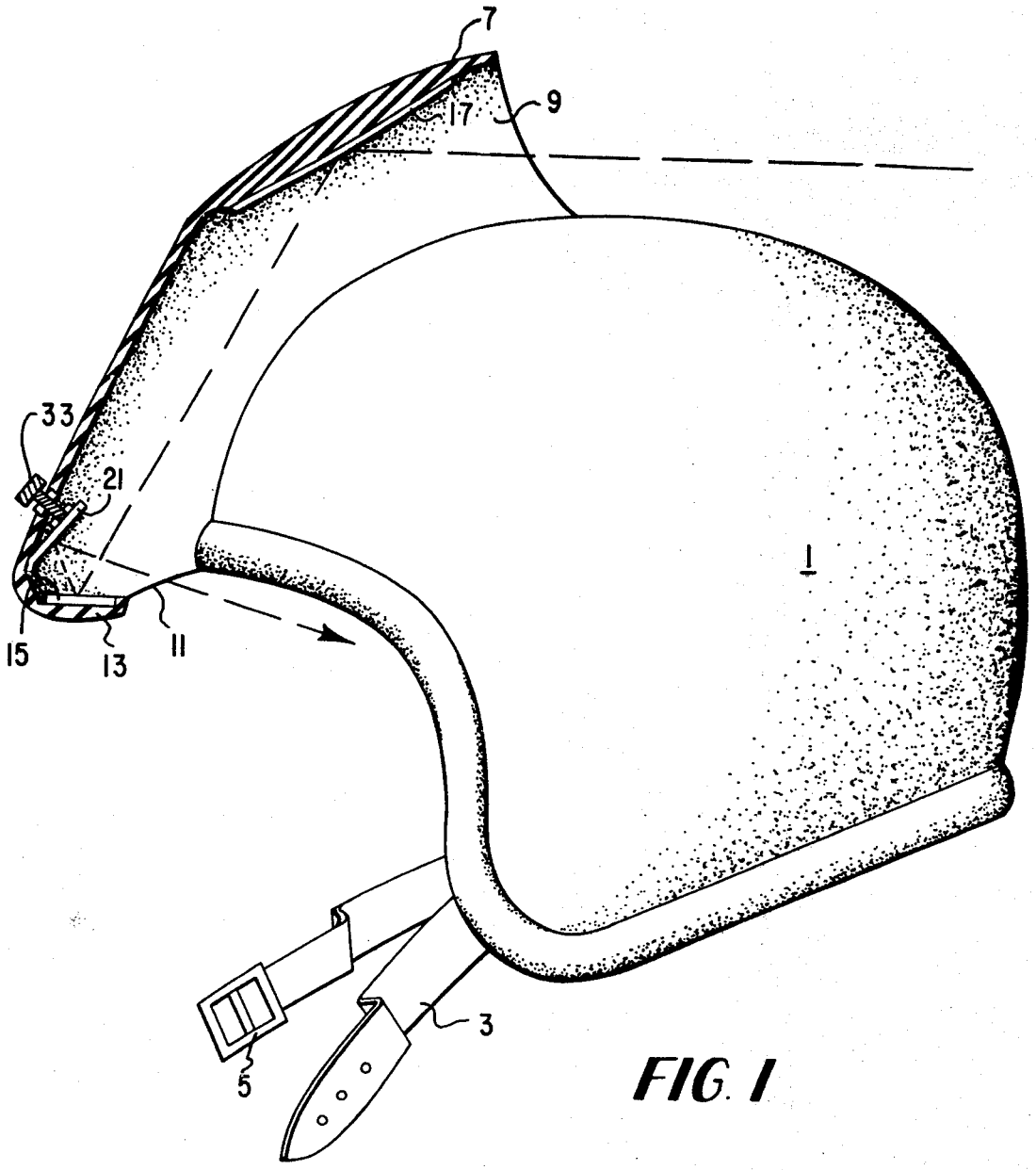

In recent years, the use of motorcycles and similar two wheeled vehicles has increased tremendously. "Bikes" as they are referred to in the vernacular, are used for recreation, such as trailriding; sport, such as racing and hill climbing; and last, but not least, as a basic economical mode of transportation.

Bike riding, however, whether for sport, or pleasure or necessity, subjects the rider to substantial danger of personal injury because in the event of a collision or loss of control of the bike, for any reason, the odds are that the rider will be thrown from the vehicle. Statistically it has been determined that a cyclist, who is thrown, will suffer severe, if not fatal head injuries unless some type of head protection is worn. Accordingly, most States have passed legislation requiring bike operators and passengers to wear protective head gear or suffer the penalty of fine or loss of operators license.

As a consequence of the noted events, protective head gear has been devised and marketed by many manufacturers and in general may be described as a high impact resistant plastic helmet shell covering the head except for the facial area and provided interiorily with some type of cushioning or suspension system whereby the helmet is firmly attached to the wearer's head but in the case of accident the cushioning or suspension system prevents violent impact from being transmitted from the impact resistant shell to the head.

Concurrently with the problem of head protection for bike operators another safety problem has evolved and that is the problem of providing adequate rear view vision for bike riders. Obviously rear vision is just as much a necessity for a bike rider as it is for the operator of a four wheeled vehicle in order to enable maneuvering of the vehicle with safety during lane changes, turning, or taking evasive action to escape possible rear end collision from a following vehicle. To date the provisions for rear vision have been unsatisfactory and in and of themselves constitute a safety hazard in the event of an accident. In general, rear vision is provided by one or more mirrors clamped to the bike handle bars and having an elongated standard which projects upwardly and outwardly to position the reflecting surface, i.e., the mirror in such a position as to provide the most wide spread field of rear vision. Since the mirrors or mirror are mounted ahead and to the side of the operator it is obvious that the operator himself or herself, as the case may be, blocks at least some of the viewing area to the rear of his trunk. Secondly, vibrations from the road and the bike engine are transmitted at least in part through the handle bars and the standard to the mirror itself with the result that, many times, the mirror or mirrors are vibrating so badly as to be substantially useless in providing any comprehensible rear vision. Additionally, in times of inclement weather exposed mirrors become so streaked or wet that the viewing area is practically obliterated.

Finally, should the bike operator be unfortunate enough to become involved in an accident, the mirrors, particularly the standards, become potentially lethal instruments should the operator be thrown forward so that his or her body comes in contact with them.

THE PRIOR ART

The present invention represents an extremely effective solution to the problem of providing adequate rear vision for a cyclist and does so by taking advantage of the fact that bike operators are required to wear head protection.

By incorporating a stable, integrated rearview periscope type system on the helmet structure an effective means is provided to obviate the disadvantages noted above.

The basic concept of providing a rearview optical system with head gear is not new. Such arrangements can be found in German Pat. No. 729,990 of 1942 and U.S. Pat. No. 1,885,744 among others. However, while disclosing the basic concept, the prior art devices are not satisfactory for use under the conditions proposed herein because virtually all of these systems are in the form of appendage attachments to the head gear and thus are susceptible to easy breakage; accidental detachment from the head gear; interfere with forward vision and/or make it difficult to handle or set aside the head gear when same is doffed or set aside during periods of non-use.

Furthermore, the prior art systems do not most efficiently and effectively position the reflecting mirrors to most effectively utilize the space forwardly of the helmet nor to attain the most efficient viewing area.

THE INVENTION

The present invention provides an optical system for a head helmet including a scanning mirror positioned adjacent the crown of the helmet for receiving rearward images and reflecting the images downwrdly to a reflecting mirror which is positioned adjacent and forwardly of the open facial area of the helmet and faces upwardly toward the scanning mirror for reflecting the rearward images from the scanning mirror generally upwardly and forwardly to a viewing mirror positioned above and forwardly of the reflecting mirror and generally facing rearwardly and downwardly for reflecting the rearward images from the reflecting mirror into the open facial area to the wearer's eyes whereby the image line between the wearer's eyes and the viewing mirror crosses the image line between the reflecting mirror and the scanning mirror.

Figure 2:
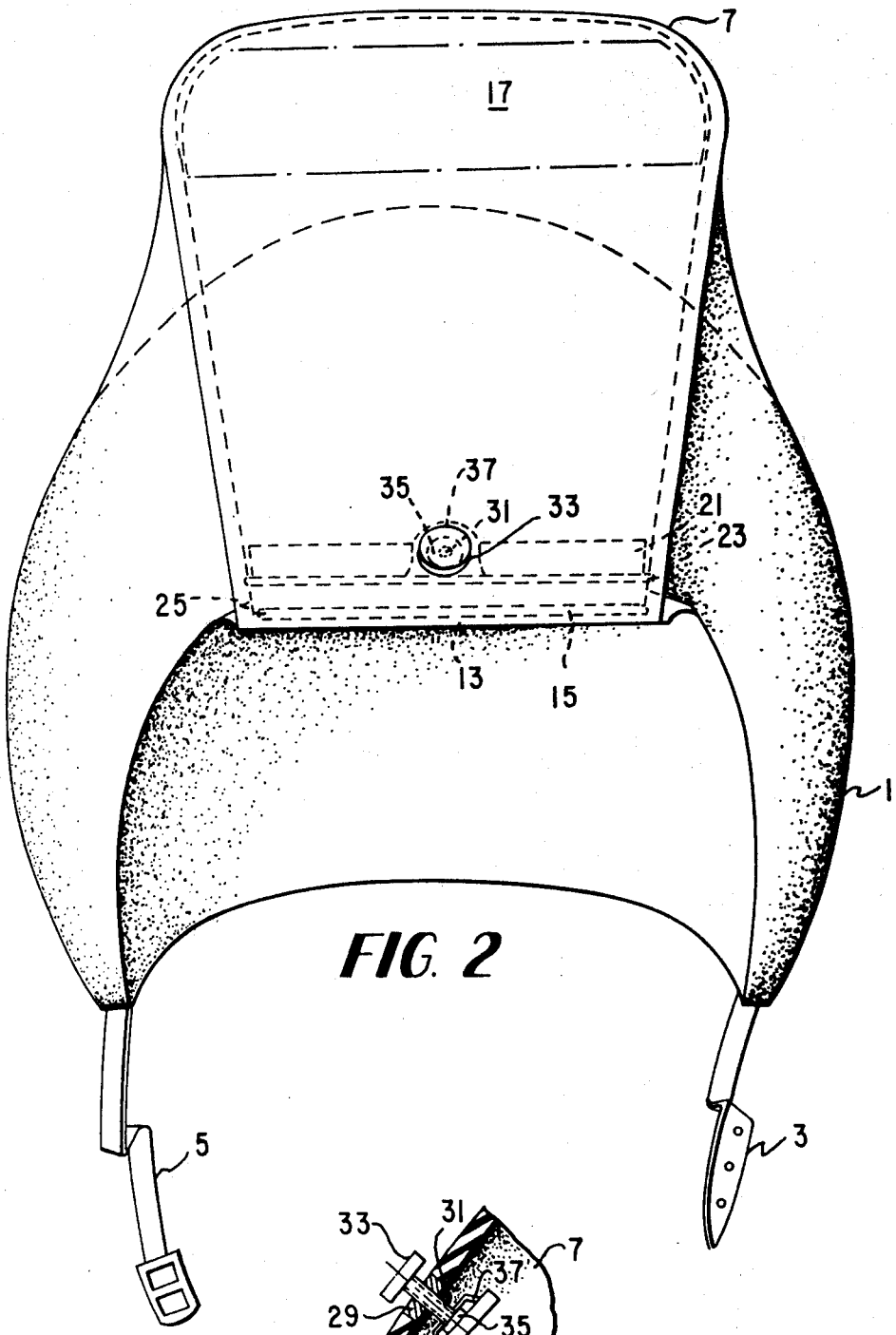
Figure 3:
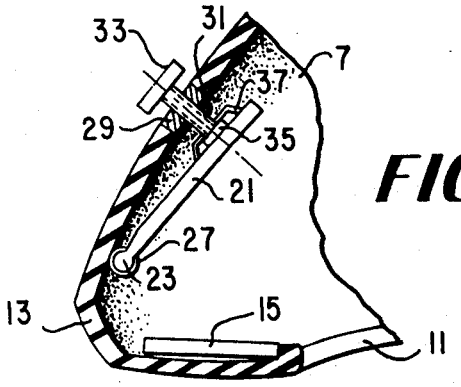
Figure 6:
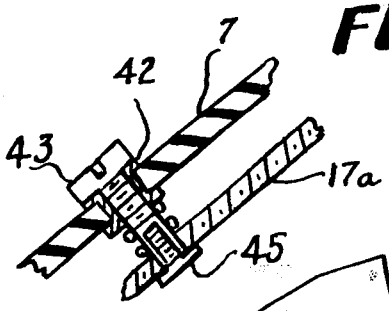
Figure 5:
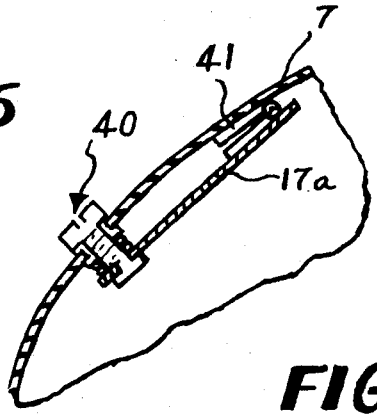
Figure 4:
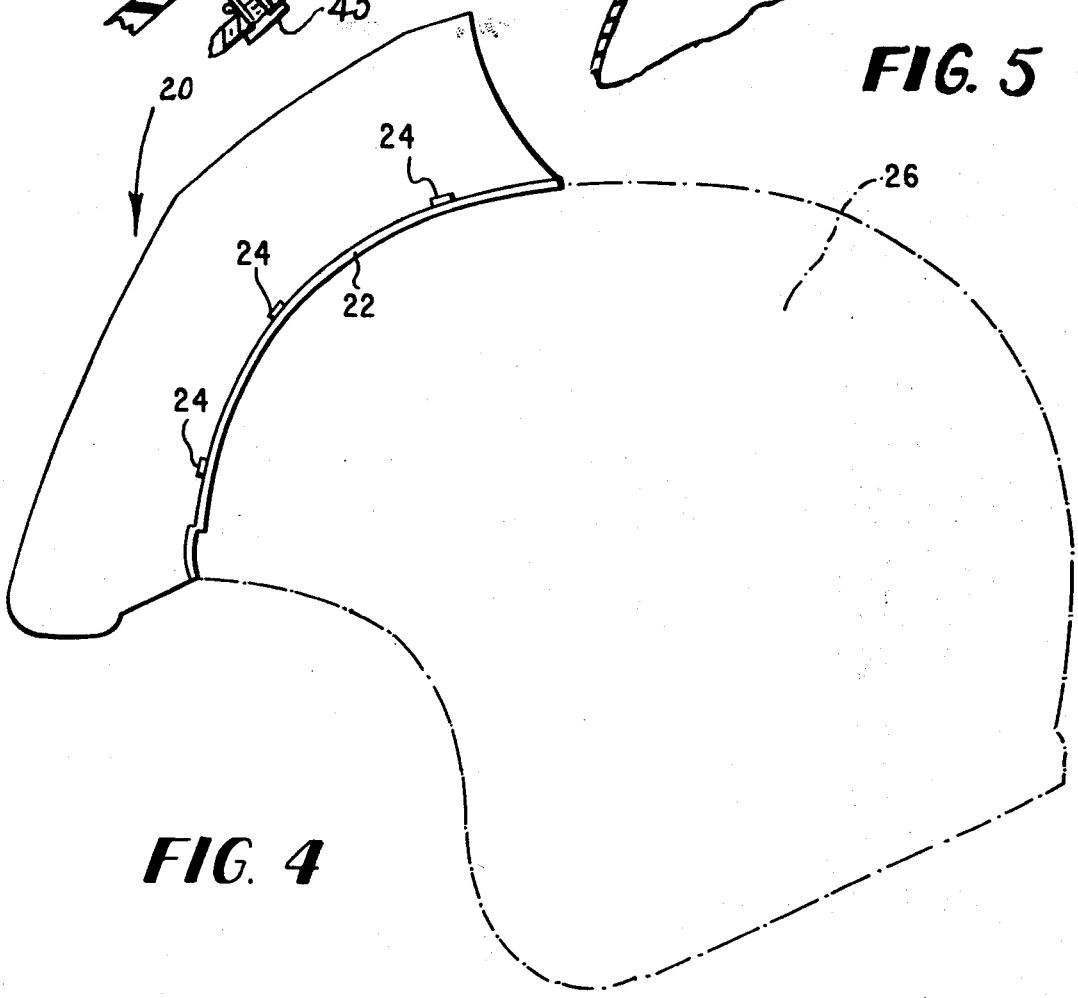

The noted purposes and objects of the invention may be attained by the head gear optical system structure to be herein described in detail and wherein reference is made to the appending drawings wherein:

FIG. 1 is a side elevational view, partly in section of the head gear optical system combination, FIG. 2 is a front view of the head gear optical system arrangement shown in FIG. 1, FIG. 3 is an enlarged view of a portion of the structure shown in FIGS. 1 and 2 and FIG. 4 is side elevational view of a modified form of the invention, a conventional helmet being shown in dotted line outline, FIG. 5 is a partial view of an adjustable image mirror and finally FIG. 6 is a partial enlarged view of the adjustment means disclosed in FIG. 6.

Considering now FIG. 1, it will be seen that the present invention is comprised of a helmet shell 1 having the usual chin straps 3 and buckle connector 5. Disposed interiorily of the helmet shell 1 is one of the various forms of head contacting padding or shell suspension systems which are not shown being no part of the present invention.

Disposed centrally of the helmet shell, as shown in FIG. 2 and extending downwardly to the facial brim of the helmet shell is a curved viewing tunnel 7 which curves upwardly and terminates with a rearwardly facing open end 9 at the crown or peak of the helmet shell. The face or brim end 11 of the tunnel is positioned so as to be just above the normal line of forward vision of the person wearing the helmet.

As clearly illustrated in FIG. 3, the brim opening 11 is at least partly circumscribed by a generally inwardly turned, horizontal lip 13 which defines the support for a flat mirror 15 facing mirror 17 disposed in the upper frontal area of tunnel 7 and in turn scanning the area defined by the rear tunnel opening 9.

Also disposed in the downwardly inclined portion of the tunnel between mirrors 15 and 17 is a third mirror 21 which is fixed to laterally extending trunnions 23, 25 which are journaled for rotary movement in the sides of the tunnel wall in apertures, of which only one 27 is shown in FIG. 3.

The front of the tunnel wall mid-way between the ends of mirror 21 is provided with a threaded bore 29 which may be simply a nut imbedded in the wall during its fabrication.

Threadedly engaged with this bore 29, is a manually rotatable threaded screw means 31, having a finger knob 33 whereby rotation thereof causes the threaded screw means to move inwardly or outwardly axially depending on the direction of rotation thereof.

The inner end 35 of the screw means 31 defines an enlarged terminus which fits behind a convex bracket 37. As the threaded member 31 is advanced the terminus 35 pushed against the back of mirror 21 to tell same downwardly. On the other hand if the screw means is rotated in the opposite direction it moves axially outwardly of the tunnel wall and the enlarged terminus 35 pulls against bracket 37 to cause the mirror 21 to tilt toward a vertical position.

From the foregoing described structure the mode of use of the device is readily apparent. A cyclist simply places the helmet on his head in its proper position and then manually adjusts the tilt position of mirror 21 until the image from mirror 17 which is reflected into mirror 15 is reflected onto mirror 21 and thence to the eye whereby the cyclist is provided with clear, unobstructed rear vision by merely the slightest eye movement above his or her normal point of forward vision.

At this point, it is believed worthy to note that so long as the optical system is sheltered within the tunnel 7 so as to move with movements of the helmet and is protected by the tunnel shell against breakage the inventive concept is satisfied. Thus, in some instances the viewing mirror 15 may be integrated in the tunnel brim 13 and the adjustable feature dispensed with entirely. Preferably, however, the most versitile embodiment of the invention would include the adjustable feature for mirror 21.

In some instances the position of the cyclist, as for example in racing where the cyclist crouches down to reduce wind resistances, it may be desirable to also provide for adjustment of the mirror 17. This arrangement is shown in FIGS. 5 and 6 wherein the mirror 17*a* is attached to the tunnel 7 by means of a leaf hinge 41 adjacent its upper edge. An adjustment means 40 is connected to the lower edge of the mirror 17*a* and is comprised of a threaded bushing 42 integrated into the tunnel wall. The bushing received a threaded adjustment screw 43 which projects through the mirror and is fastened thereto by means of a retainer screw 45 which is threaded into the end of adjustment screw 45. A small coil spring 47 surrounds the adjustment screw 45 and bears against the back of mirror 17*a* and the inner end of bushing 42 to bias the mirror against the retainer screw. It should, of course, be recognized that other adjustment arrangements may be used.

Since the entire optical system is mounted within the tunnel, the reflective surfaces are securely protected at all times. Further, once mirror 21 is properly adjusted there is little need to readjust same as it too is securely protected and will not readily be dislodged from its tilt position due to the resistance of the screw means to any axial movement unless it is rotated by conscious physical effort.

As shown in FIGS. 1 to 3 inclusive the entire rearview system is formed as an integral part of the helmet shell 1, the various reflective surfaces being embedded or otherwise held in place during the manufacturing process.

In FIG. 4 there is shown a rearview system 20 which is virtually identical to the structure defined in FIG. 1 in all essential particulars except one; it is not integrally formed with the helmet shell. In this version the tunnel is provided with laterally extending flanges such as 22, through which may be passed suitable fastners such as rivets 24 or the like to anchor the unit to a helmet shell 26. This added on structure permits use of the invention on existing cyclist protective helmets and it is contemplated that various countours can be give to the flanges whereby the unit can be applied to any presently available helmet shell now being marketed.

It will be apparent from the foregoing description that various modifications and changes may occur to those skilled in the art, all within the spirit and scope of the invention which is defined by the claims, wherein:

What is claimed is:

1. A head helmet comprising: a head protective shell having a crown, a brim extremity defining the top of an open facial area and a frontal area extending downwardly from said crown to said brim extremity; optical means supported on said shell forwardly of said frontal area thereof for reflecting an image line passing forwardly over said crown downwardly to the wearer's eyes to provide a rearward view for the wearer; said optical means including a scanning mirror positioned adjacent said crown for receiving rearward images and reflecting same downwardly, a reflecting mirror positioned adjacent and spaced forwardly of said brim extremity and facing generally upwardly toward said scanning mirror for reflecting the rearward images from said scanning mirror generally upwardly and forwardly, and a viewing mirror positioned above and forwardly of said reflecting mirror and said brim extremity and generally facing rearwardly and downwardly for reflecting the rearward images from said reflecting mirror through the space between said reflecting mirror and said brim extremity and into the open facial area to the wearer's eyes whereby the image line between the wearer's eyes and said viewing mirror crosses the image line between said reflecting mirror and said scanning mirror.

2. A head helmet as set forth in claim 1 wherein said optical means includes a tunnel having a rearwardly facing open top end adjacent said crown and an at least partially open bottom end adjacent said brim extremity, said mirrors being supported within said tunnel.

3. A head helmet as set forth in claim 2 wherein said tunnel includes a generally horizontally disposed lip extending inwardly toward said brim extremity at the bottom end thereof, said reflecting mirror being supported by said lip.

4. A head helmet as set forth in claim 2 wherein said tunnel and said mirrors supported thereby define a separate unit attached to said shell by fastening means.

5. A head helmet as set forth in claim 2 wherein said tunnel is formed integrally with said shell.

6. A head helmet as set forth in claim 2 wherein at least one of said scanning mirror and said viewing mirror is adjustably supported by said tunnel.

7. A head helmet comprising: a head protective shell having a crown, a brim extremity defining the top of an open facial area, and a frontal area extending downwardly from said crown to said brim extremity; optical means supported on said shell forwardly of said frontal area thereof for reflecting an image line passing forwardly over said crown downwardly to the wearer's eyes to provide a rearward view for the wearer; said optical means including a viewing mirror positioned forwardly of said brim extremity and generally facing the open facial area, a refecting mirror positioned below and downwardly of said viewing mirror and spaced forwardly of said brim extremity and facing generally upwardly, and a scanning mirror positioned adjacent said crown from reflecting rearward images downwardly to said reflecting mirror which, in turn, reflects same to said viewing mirror which, in turn, reflects same through the space between said reflecting mirror and said brim extremity and toward the open facial area whereby the image line between the wearer's eyes and said viewing mirror crosses the image line between said reflecting mirror and said scanning mirror.

* * * * *